US009045203B1

(12) United States Patent
Alphin

(10) Patent No.: US 9,045,203 B1
(45) Date of Patent: Jun. 2, 2015

(54) PADDLEBOARD STORAGE AND SEAT SUPPORT ASSEMBLY

(71) Applicant: Kent Alphin, Wilmington, NC (US)

(72) Inventor: Kent Alphin, Wilmington, NC (US)

( * ) Notice: Subject to any disclaimer, the term of this patent is extended or adjusted under 35 U.S.C. 154(b) by 100 days.

(21) Appl. No.: 13/803,806

(22) Filed: Mar. 14, 2013

(51) Int. Cl.
*B63B 35/85* (2006.01)

(52) U.S. Cl.
CPC ..... *B63B 35/85* (2013.01)

(58) Field of Classification Search
CPC .. B63B 35/75; B63B 35/7909; B63B 35/7906
USPC ..... 441/129, 79, 130, 74; 602/19
See application file for complete search history.

(56) References Cited

U.S. PATENT DOCUMENTS

| | | | | | |
|---|---|---|---|---|---|
| 3,377,007 | A * | 4/1968 | Gayler, Jr. | 224/609 |
| 4,452,161 | A * | 6/1984 | McCoy | 114/39.18 |
| 4,623,316 | A * | 11/1986 | Ratliff | 441/106 |
| 4,745,870 | A * | 5/1988 | Roth | 114/39.18 |
| 4,795,381 | A * | 1/1989 | Willems | 440/26 |
| 4,804,025 | A * | 2/1989 | Bear | 224/604 |
| 4,894,035 | A * | 1/1990 | Pia | 441/79 |
| 5,179,942 | A * | 1/1993 | Drulias et al. | 128/101.1 |
| 5,569,057 | A * | 10/1996 | Barsdorf et al. | 441/65 |
| 5,643,184 | A * | 7/1997 | Toso | 602/19 |
| D390,001 | S * | 2/1998 | Lovelady et al. | D3/221 |
| 5,820,430 | A * | 10/1998 | Hornsby et al. | 441/65 |
| 5,860,944 | A * | 1/1999 | Hoffman, Jr. | 602/19 |
| 6,129,691 | A * | 10/2000 | Ruppert | 602/19 |
| 6,213,831 | B1 * | 4/2001 | Smith | 441/65 |
| 6,227,925 | B1 * | 5/2001 | Boddy | 441/129 |
| 6,319,217 | B1 * | 11/2001 | Darcey | 602/19 |
| 6,436,065 | B1 * | 8/2002 | Mitchell | 602/19 |
| 7,798,877 | B1 * | 9/2010 | Wortham | 441/79 |
| 7,931,571 | B2 * | 4/2011 | Bernardoni | 482/124 |
| 8,088,088 | B2 * | 1/2012 | Hurley | 602/18 |
| 8,336,475 | B2 * | 12/2012 | Morin | 114/39.22 |
| 8,696,396 | B1 * | 4/2014 | Churchill et al. | 441/66 |
| 2006/0046589 | A1 * | 3/2006 | Farley et al. | 441/108 |

* cited by examiner

*Primary Examiner* — Lars A Olson
*Assistant Examiner* — Jovon Hayes

(57) ABSTRACT

A paddleboard storage and seat support assembly attaches to a paddleboard to store items while also being convertible to a support while in a seated position on the paddleboard. The assembly includes a panel having opposite ends and a straps. The straps are selectively couplable to the panel wherein the panel is positionable to abut a back of a person in an upright position while the person is seated on a paddleboard. The straps have a length wherein the straps extend from the opposite ends of the panel and are couplable to at least one foot of the person wherein the straps holds the panel in abutment with the back of the person. The straps may also couple the panel to a paddleboard allowing items to be held on the paddleboard by the panel and straps.

10 Claims, 5 Drawing Sheets

PADDLEBOARD STORAGE AND SEAT SUPPORT ASSEMBLY

BACKGROUND OF THE DISCLOSURE

Field of the Disclosure

The disclosure relates to storage devices and more particularly pertains to a new storage device for attaching to a paddleboard to store items on a paddleboard while also being convertible to a support while in a seated position on the paddleboard.

SUMMARY OF THE DISCLOSURE

An embodiment of the disclosure meets the needs presented above by generally comprising a panel having opposite ends and a strap. The strap is selectively couplable to the panel wherein the panel is positionable to abut a back of a person in an upright position while the person is seated on a paddleboard. The strap has a length wherein the strap extends from the opposite ends of the pad and is couplable to at least one foot of the person wherein the strap holds the panel or pad in abutment with the back of the person. The strap may also couple the panel to a paddleboard allowing items to be held on the paddleboard by the pad and strap.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
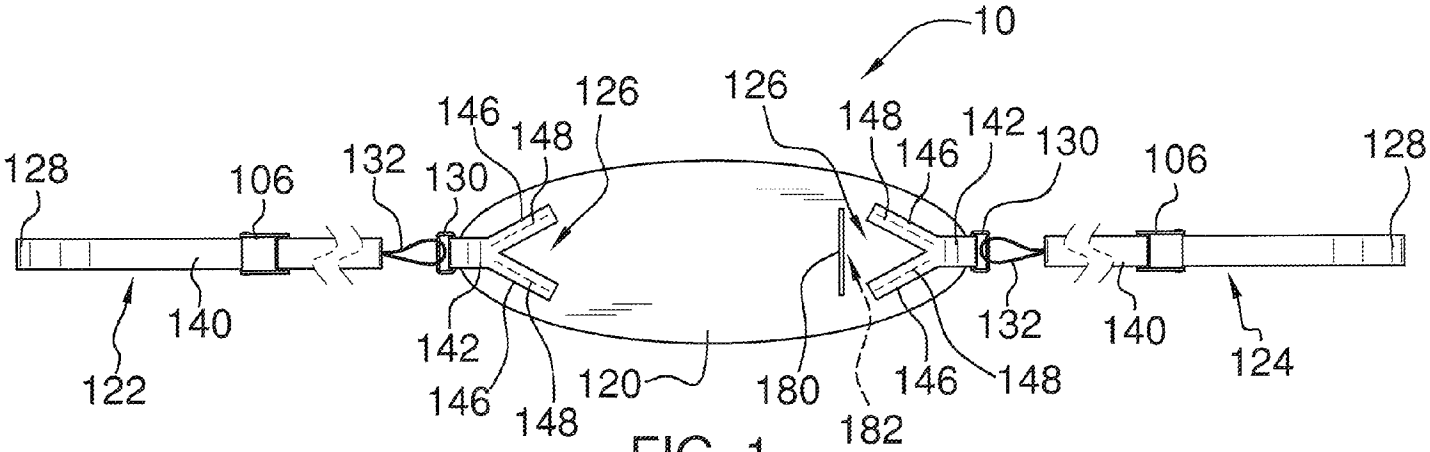
FIG. 1 is a bottom view of a paddleboard storage and seat support assembly according to an embodiment of the disclosure.

With reference now to the drawings, and in particular to FIGS. 1 through 9 thereof, a new storage device embodying the principles and concepts of an embodiment of the disclosure and generally designated by the reference numeral 10 will be described.

As best illustrated in FIGS. 1 through 9, the paddleboard storage and seat support assembly 10 generally comprises a panel 120 or pad 12 which can be strapped to a paddleboard 26 to facilitate storage of items on the paddleboard 26. The panel 120 or pad 12 can be positioned behind a person 22 and held in position by a strap 18 or straps 122,124 to support the person 22 in a seated position on the paddleboard 26.

Figure 2:
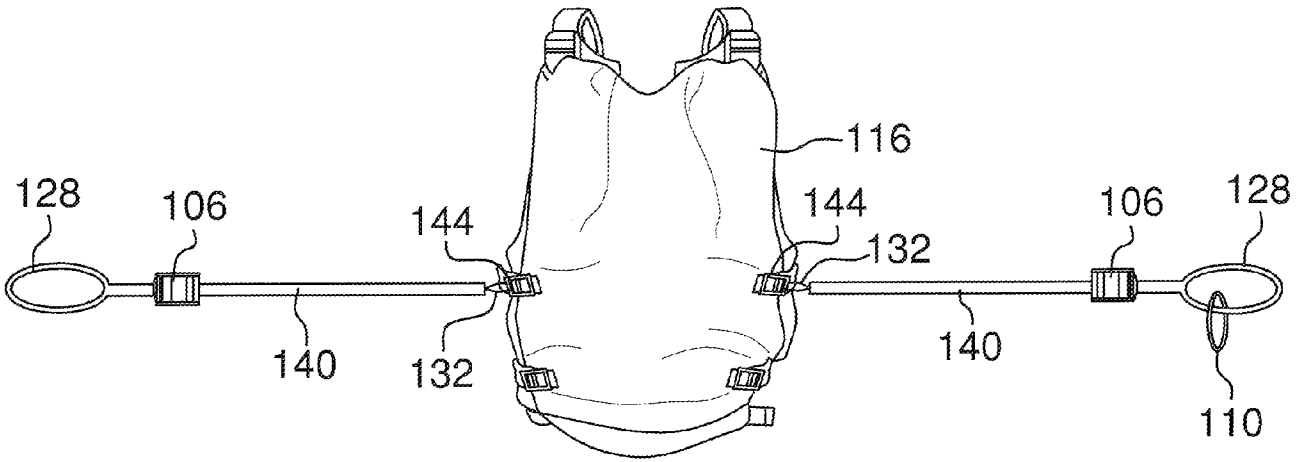
FIG. 2 bottom view of an embodiment of the disclosure.
Figure 3:
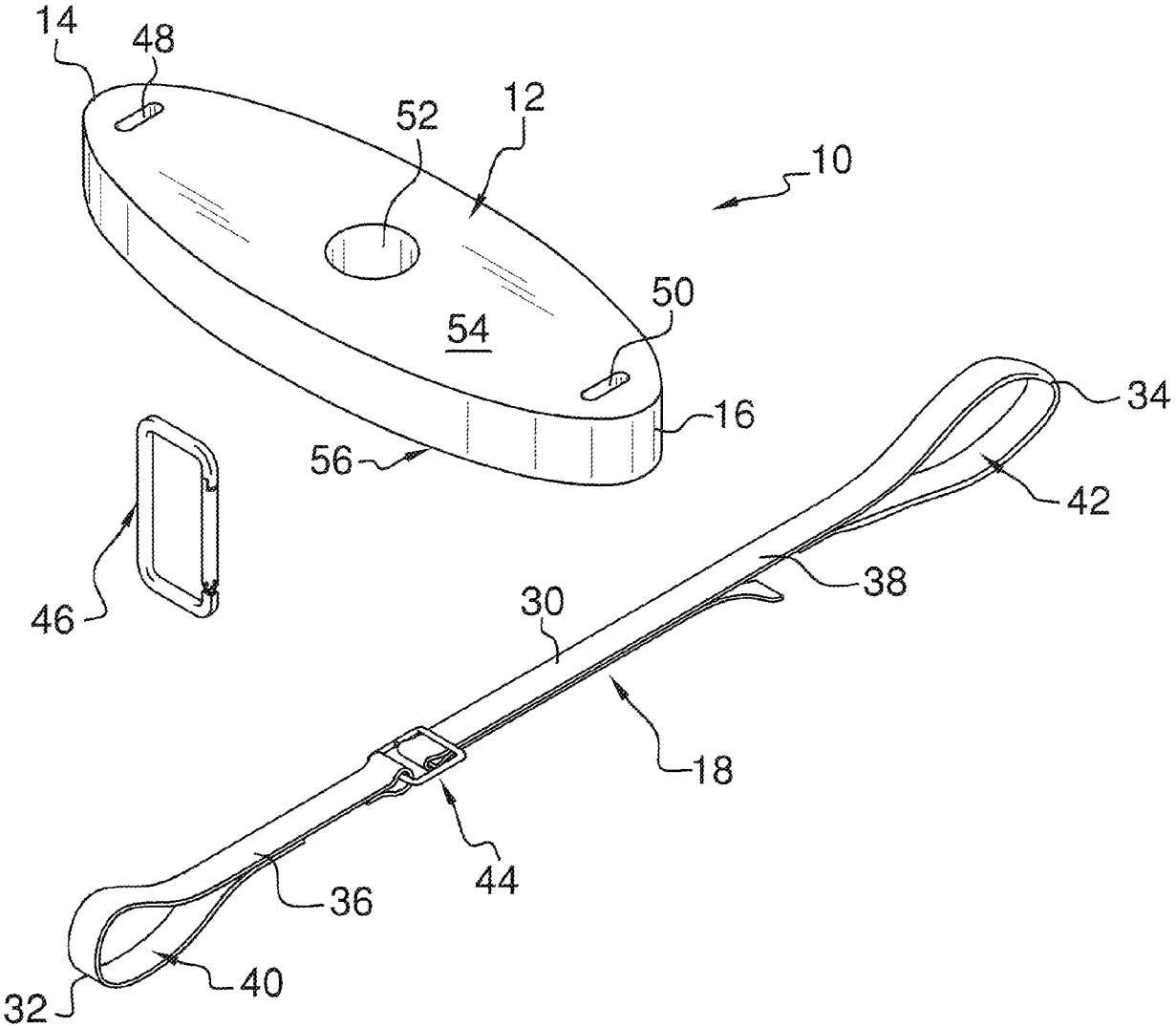
FIG. 3 is a top front side perspective view of an embodiment of the disclosure.
Figure 4:
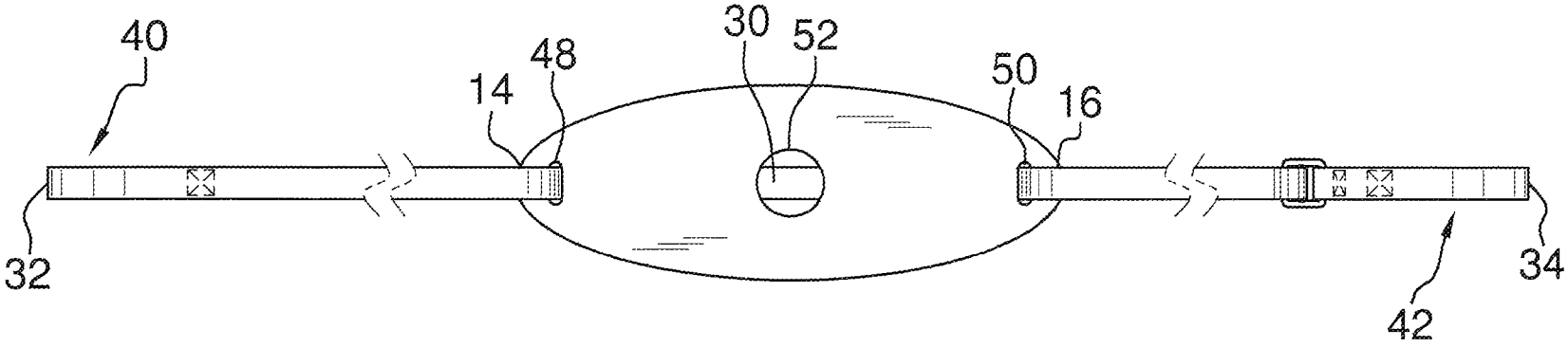
FIG. 4 is a top view of an embodiment of the disclosure.
Figure 5:
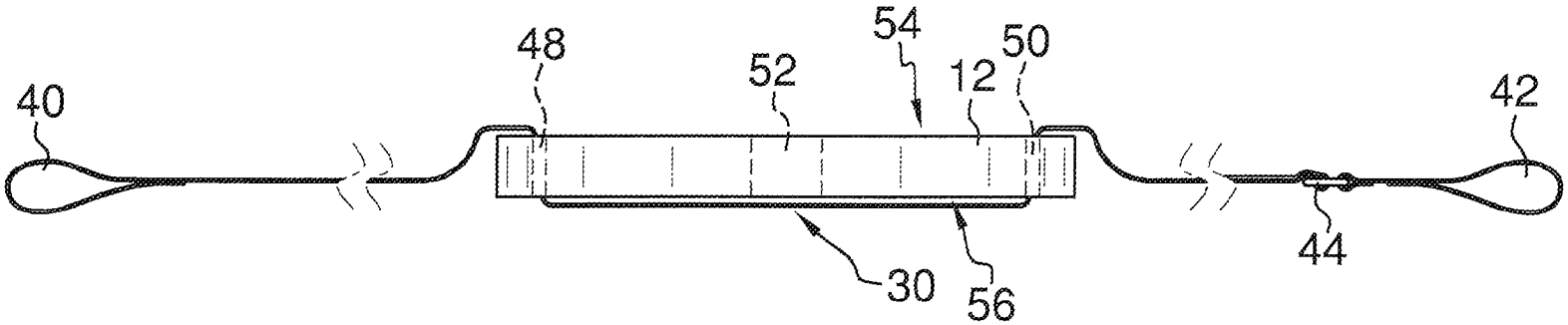
FIG. 5 is a front view of an embodiment of the disclosure.
Figure 6:
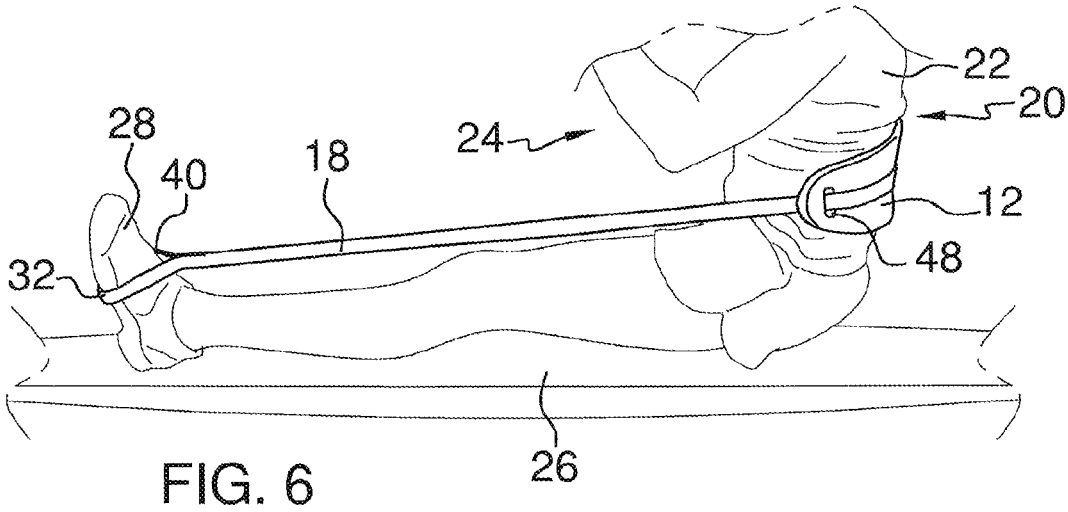
FIG. 6 is a side view of an embodiment of the disclosure in use.
Figure 7:
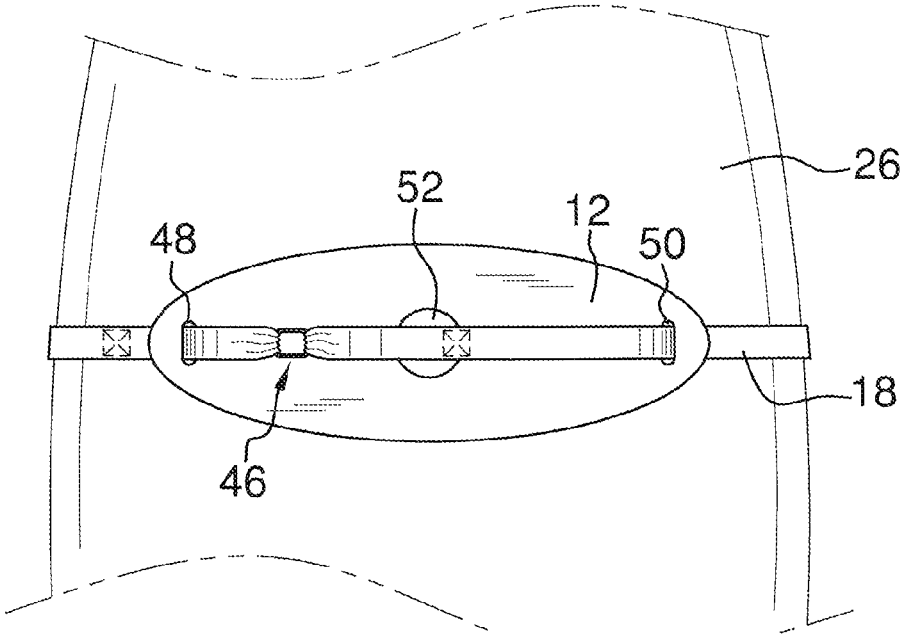
FIG. 7 is a top view of an embodiment of the disclosure in use.

In an embodiment as shown in FIGS. 1 and 2, a thin but durable fabric panel 120 is utilized. The panel 120 may be stiff or flexible. Each of a pair of straps 122,124, has a respective first end 126 and a looped second end 128. The first end 126 of each strap 122,124 may be a split and coupled to the panel 120 by stitching or another conventional attachment method. Distal portions 140 of each of the straps 122, 124 may be attached to proximal portions 142 by a clip 132 and loop 130 to permit selective removal of the distal portions 140 from the panel 120. As shown in FIG. 1, the distal portions 140 may then be attached to a buckle 144 or the like on the floatation jacket or vest 116 instead of the panel 120 to provide direct back support to the wearer of the vest 116. Each of the distal portions 140 may have adjustable lengths using cam buckles 106 or the like. A ring 110 may also be provided with a gap or slit to permit the ring 110 to be selectively coupled to the straps 122,124 as desired. The proximal portions 142 may each have split arms 146 coupled to the panel 120 by stitching 148 or another conventional attachment method. The split arms 146 may be symmetrical along a longitudinal axis of the panel 120. The panel 120 may be doubled over and stitched to form a pocket 182. A slit 180 may extend through the panel 120 into the pocket 182.

In an embodiment shown in FIGS. 3 through 7, a pad 12 having opposite ends 14,16 and a strap 18. The strap 18 is selectively couplable to the pad 12 wherein the pad 12 is positionable to abut a back 20 of a person 22 in an upright position 24 while the person 22 is seated on a paddleboard 26. The strap 18 has a length wherein the strap 18 extends from the opposite ends 14,16 of the pad 12 and is couplable to at least one foot 28 of the person 22. The strap 18 holds the pad 12 in abutment with the back 20 of the person 22. The pad 12 is coupled to a medial extent 30 of the strap 18. The strap 18 has a first end 32 and a second end 34 extending from the pad.

A first loop 40 is positioned at the first end 32 of the strap 18. The first loop 40 is configured for selectively receiving the foot 28 therethrough wherein the first loop 40 is coupled to the foot 28. A second loop 42 is positioned at a second end 34 of the strap 18. The second loop 42 is configured for selectively receiving the foot 28 therethrough wherein the second loop 42 is coupled to the foot 28.

The strap 18 may also include a first section 36 and a second section 38. A buckle 44 couples the first section 36 to the second section 38 wherein a length of the strap 18 is adjustable. A clip 46 is couplable to the strap 18. The clip 46 is selectively couplable to the first loop 40 and the second loop 42 wherein the strap 18 is configured for extending and tightening around the paddleboard 26 such that the pad 12 is secured against the paddleboard 26. The clip 46 may be coupled to the first loop 40 and the second loop 42 and the length of the strap 18 adjusted to secure the strap 18 and pad 12 to the paddleboard 26. The clip 46 may be substantially rectangular having opposite long sides and opposite short sides. One of the long sides may pivot allowing that side to be pushed inwardly to open the clip 46. Additional items may be attached to the clip 46 while in use on the strap 18 as described or the strap 18 may be simply passed through the clip 46 allowing items to be held on the strap 18 in that manner.

In an embodiment shown in FIGS. 3 through 7, a pair of spaced slots 48,50 may extend through the pad 12. Each slot 48,50 is positioned proximate an associated one of the opposite ends 14,16 of the pad 12. The strap 18 is insertable through each of the slots 48,50 wherein the strap 18 is coupled to the pad 12.

An aperture 52 extends into the pad 12. The aperture 52 extends fully between an upper surface 54 and a lower surface 56 of the pad 12. The aperture 52 may be centrally positioned in the pad 12. The aperture 52 may be aligned between the slots 48,50 wherein the strap 18 extends across the aperture 52 when the strap 18 extends between the slots 48,50. The strap 18 may be positioned between the pad 12 and the paddleboard 26 to permit full access to the aperture 52. Items such as beverage containers or excess portions of the strap 18 may be positioned in the aperture 52. Alternatively, the pad 12 may be coupled to the paddleboard 26 such that the strap 18 extends over the aperture 52 wherein the strap will assist to hold items in the aperture 52 such as keys or jewelry.

Figure 8:
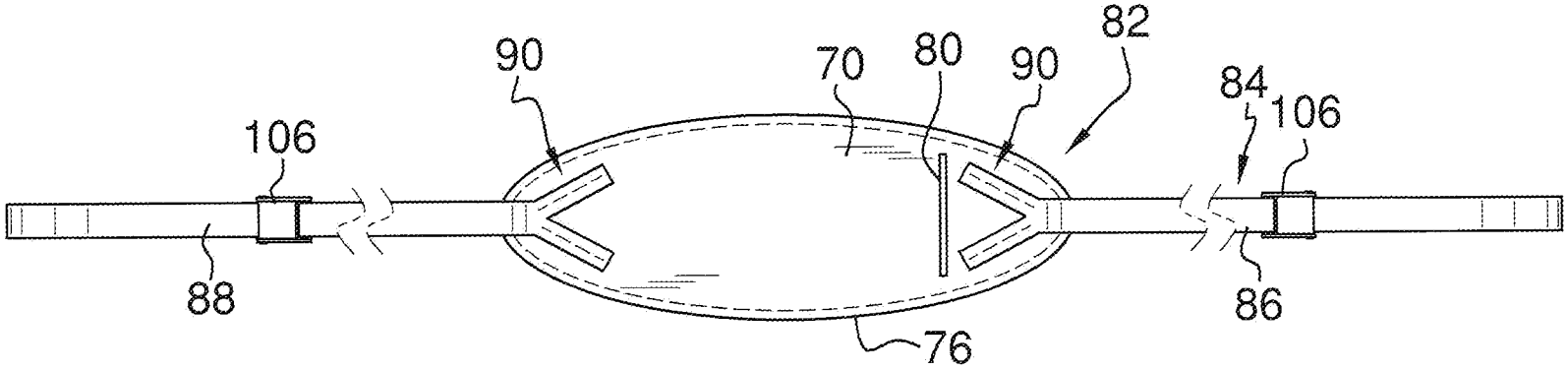
FIG. 8 is a bottom view of an embodiment of the invention.
Figure 9:
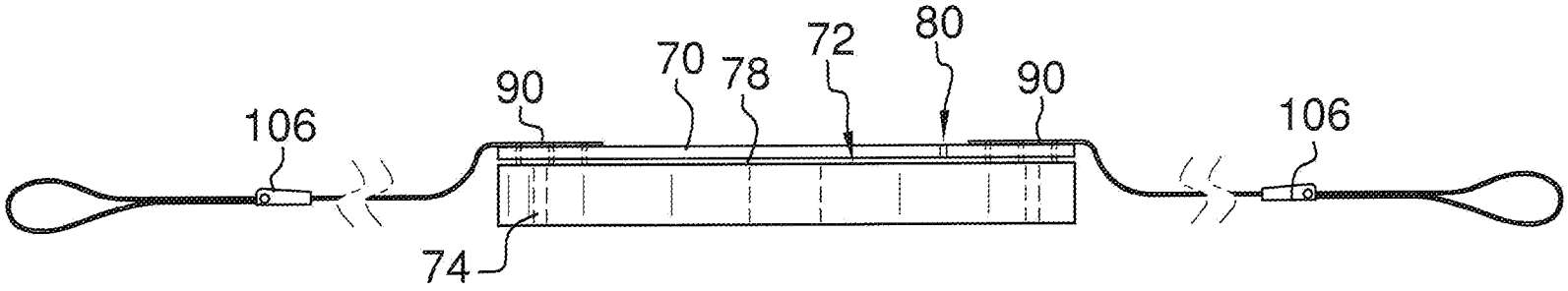
FIG. 9 is a front view of an embodiment of the invention.

In an embodiment shown in FIGS. 8 and 9, a backing 70, similar to the panel 120 described above, is coupled to and extends across a rear face 72 of the pad 74. The backing 70 may be coupled to the pad 74 proximate a perimeter edge 76 of the backing 70 using stitches, adhesive, or another conventional form of attachment, forming a pocket 78 between the backing 70 and the pad 74. Alternatively, the pocket 78 may be formed in the backing 70 alone by doubling over the material forming the backing 70. A slit 80 may extend through one of the backing 70 or the pad 74 into the pocket 78. In such an embodiment, the pad 74 may otherwise be structured similarly to the pad 12 above but would not typically include the aperture 52. Although the slit 80 may extend through the pad 74, the slit 80 is typically extended through the backing 70 proximate an end 82 of the backing 70. The pad 74 may be utilized with a strap 84 having a first portion 86 and a second portion 88. The first portion 86 and the second portion 88 may each have a split proximal end 90 relative to the pad 74. Each split proximal end 90 may be coupled to the pad 74 by stitching or another conventional attachment method. The first portion 86 and second portion 88 having adjustable lengths using cam buckles 106 or the like. The ring 110 may also be selectively coupled to the straps 18,84 as desired.

In use, the panel 120 or pad 12 is attached to the paddleboard 26 by straps 122,124 or strap 18 respectively. The panel 120 or pad 12 may be used to hold items on the paddleboard 26 by holding the item against the paddleboard 26. This is particularly useful for substantially planar items such as an auxiliary oar head. When needed, the panel 120 or pad 12 is removed from the paddleboard 26 and may be positioned as described above to support the person 22 in a seated position on the paddleboard 26 when the auxiliary oar head may be attached to an otherwise single oared paddle. Thus, when tired, the person 22 may utilize an embodiment of the assembly 10 to facilitate use of the paddleboard 26 in a manner similar to a kayak.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A paddleboard seat support assembly comprising:

a pad having opposite ends, said pad being elongated between said opposite ends;

a strap, said strap having a first section and a second section, said strap being selectively couplable to said pad wherein said pad is positionable to abut a back of a person in an upright position while the person is seated on a paddleboard, said strap having a length wherein said strap extends from said opposite ends of said pad and is couplable to at least one foot of the person wherein said strap holds said pad in abutment with the back of the person, said pad being coupled to a medial extent of said strap, said strap having a first end and a second end extending from said pad;

a first loop positioned at a first end of said strap, said first loop being configured for selectively receiving the foot therethrough wherein said first loop is coupled to the foot;

a second loop positioned at a second end of said strap, said second loop being configured for selectively receiving the foot therethrough wherein said second loop is coupled to the foot;

a buckle coupling said first section to said second section wherein a length of said strap is adjustable; and a clip, said clip being selectively couplable to said first loop and said second loop wherein said strap is configured for extending and tightening around the paddleboard such that said pad is secured against the paddleboard.

2. The assembly of claim 1, further comprising an aperture extending into said pad.

3. The assembly of claim 1, further comprising:

said strap having a first section and a second section; and a buckle coupling said first section to said second section wherein a length of said strap is adjustable.

4. The assembly of claim 3, further comprising a clip, said clip being couplable to said strap.

5. The assembly of claim 1, further comprising spaced slots extending through said pad, each slot being positioned proximate an associated one of said opposite ends of said pad, said strap being insertable through each of said slots wherein said strap is coupled to said pad.

6. The assembly of claim 5, further comprising an aperture extending into said pad, said aperture being aligned between said slots wherein said strap extends across said aperture when said strap extends between said slots.

7. A paddleboard seat support assembly comprising:

a pad having opposite ends; and a strap, said strap being selectively couplable to said pad wherein said pad is positionable to abut a back of a person in an upright position while the person is seated on a paddleboard, said strap having a length wherein said strap extends from said opposite ends of said pad and is couplable to at least one foot of the person wherein said strap holds said pad in abutment with the back of the person, said pad being coupled to a medial extent of said strap, said strap having a first end and a second end extending from said pad, said strap having a first section and a second section;

a first loop positioned at a first end of said strap, said first loop being configured for selectively receiving the foot therethrough wherein said first loop is coupled to the foot; and a second loop positioned at a second end of said strap, said second loop being configured for selectively receiving the foot therethrough wherein said second loop is coupled to the foot;

a buckle coupling said first section to said second section wherein a length of said strap is adjustable;

a clip, said clip being couplable to said strap, said clip being selectively couplable to said first loop and said second loop wherein said strap is configured for extending and tightening around the paddleboard such that said pad is secured against the paddleboard;

a pair of spaced slots extending through said pad, each slot being positioned proximate an associated one of said opposite ends of said pad, said strap being insertable through each of said slots wherein said strap is coupled to said pad; and an aperture extending into said pad, said aperture extending fully between an upper surface and a lower surface of said pad, said aperture being centrally positioned in said pad, said aperture being aligned between said slots wherein said strap extends across said aperture when said strap extends between said slots.

8. The assembly of claim 7, further comprising a backing coupled to and extending across a rear face of said pad.

9. The assembly of claim 8, further comprising:

said backing being doubled over material coupled to said pad proximate a perimeter edge of said backing forming a pocket; and a slit extending through said backing into said pocket.

10. The assembly of claim 9, wherein said slit extends through said backing.

* * * * *